United States Patent [19]

Kay

[11] Patent Number: 4,530,410

[45] Date of Patent: Jul. 23, 1985

[54] HOLE BORING APPARATUS AND METHOD

[76] Inventor: William E. Kay, 15 Bramley Rd., East Peckham, Near Tonbridge, Kent, England

[21] Appl. No.: 445,173

[22] Filed: Nov. 29, 1982

[51] Int. Cl.[3] ..... E21B 7/00; E21B 10/44

[52] U.S. Cl. ..... 175/57; 175/323

[58] Field of Search ..... 175/57, 88, 171, 323

[56] References Cited

U.S. PATENT DOCUMENTS

| | | | |
|---|---|---|---|
| 1,398,551 | 11/1921 | Hanson | 175/171 X |
| 2,245,750 | 6/1941 | Betts | 175/57 |
| 2,979,143 | 4/1961 | Kandle | 175/171 |
| 4,057,117 | 11/1977 | Bermingham | 175/88 |

FOREIGN PATENT DOCUMENTS

| | | | |
|---|---|---|---|
| 222548 | 5/1910 | Fed. Rep. of Germany | 175/323 |
| 2837397 | 8/1978 | Fed. Rep. of Germany | 175/88 |
| 1125853 | 8/1968 | United Kingdom | 175/171 |

*Primary Examiner*—Stephen J. Novosad

*Assistant Examiner*—Bruce M. Kisliuk

*Attorney, Agent, or Firm*—Wenderoth, Lind & Ponack

[57] ABSTRACT

A hole boring apparatus includes an upright frame 20 along which can be moved a carriage 20 carrying a hydraulic motor 29 driving a square-section socket 29 in rotation. The top end of a train of square-section bars 40 is engaged in the socket, and an auger 40 surrounding the bars is axially slidable on the bars but is driven thereby in rotation. The auger is suspended from a carrier, relative to which the auger and bars can rotate. The auger is raised and lowered by means of a cable connected to one end of a lever mounted on the carrier. When the cable is untensioned the lever falls outwards into a position in which it engages either an axially-extending rib on the internal surface of a leading steel liner section for the hole or, if there is no liner, the side of the hole, so as to prevent the carrier from rotating with the auger and bars. When the cable is tensioned to lift the carrier, auger and spoil the lever is automatically freed from this engagement.

17 Claims, 7 Drawing Figures

HOLE BORING APPARATUS AND METHOD

BACKGROUND AND SUMMARY OF THE INVENTION

This invention relates to hole boring apparatus and a method of boring holes.

According to the invention in one aspect there is provided hole boring apparatus comprising an elongate bar, means for rotating the bar about its lengthwise axis, an auger surrounding the bar which auger is slidable lengthwise of the bar but is not rotatable relative to the bar, a carrier slidable along the bar and free for rotation relative to the bar, said carrier having the auger connected thereto by a connection permitting rotation of the auger relative to the carrier, a device on the carrier operative to prevent or limit the extent of rotation of the carrier about said axis, and means for raising and lowering the carrier along the bar.

According to the invention in another aspect there is provided a method of boring a hole in the ground comprising lowering along a vertical bar which is capable of boring into the ground, an assembly comprising an auger and a carrier therefor until the auger reaches the ground, the carrier and the auger being mounted on and concentrically with the bar, said carrier being free for rotation relative to the bar and the auger, and the auger being suspended from the carrier and in driven engagement with the bar, causing the bar and auger to rotate while preventing the carrier from rotating with the bar, and causing the carrier, with the auger suspended therefrom, to be hoisted along the bar when the auger has collected a quantity of spoil.

BRIEF DESCRIPTION OF THE DRAWINGS

One embodiment of the invention will now be described with reference to the accompanying drawings in which.

DETAILED DESCRIPTION OF THE PREFERRED EMBODIMENTS

Figure 1:
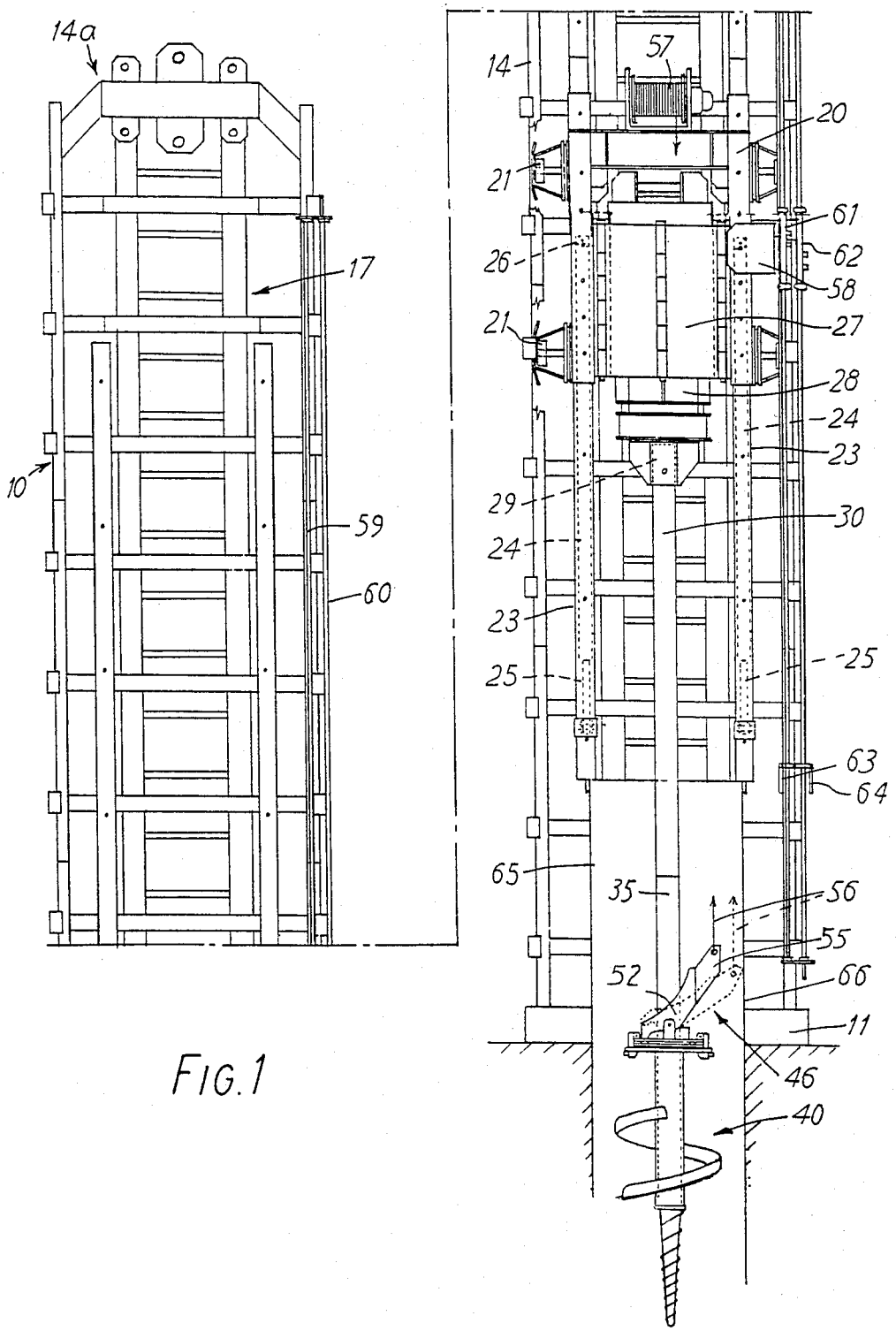
FIG. 1 shows a front view of a hole boring apparatus according to the invention.

Referring to FIGS. 1 to 3, 4A and 4B of drawings, a hole boring apparatus is shown which has a fixed frame 10 standing on a generally arcuate base member 11 secured to the ground so as to extend about part of the circumference of the hole to be bored. The frame is constructed from a series of identical upright frame members 12 (see also FIGS. 4A, 4B and 5) which are secured together one above the other to make up the required height. The frame members 12 are semihexagonal viewed in plan as in FIG. 4A and comprise two inwardly facing vertical channel section members 14 interconnected by three sets of three horizontal members 15 which are braced by angle plates 16 at their junctions. The three sets of horizontal members have secured to them a ladder section 17 comprising parallel uprights 18 interconnected by rungs 19. The top frame member 12*a* is slightly different from the others in that the upper end of the ladder section 17*a* is directed forward and joined to an assembly 14*a* interconnecting the upper ends of the channel-section members 14.

A rectangular carriage 20 mounted on four rollers 21 has its rollers at opposite sides engaged in the two vertical channel-section members 14, and the weight of the carriage and the components carried thereby are supported on two upright members 23 through a pair of double-acting hydraulic jacks 24 whereof the piston rods 25 are respectively connected to the upright members and the cylinders are connected to the carriage at 26.

A rotary hydraulic motor 27 is mounted on the trolley with the motor output shaft disposed vertically, and a universal coupling member 28 mounted on the motor housing has its input member connected to the motor shaft and provides a rotary output drive member formed with a downwardly facing square section socket 29. The top bar 30 of a vertical train of square-section Kelly bars is engaged in the socket 29 and secured by a pin 31 extending through aligned holes in the bar and socket. The lower end portion 32 of each Kelly bar is of reduced cross-section (see FIG. 3) and fits into a deep socket in the top end portion of the next lower Kelly bar. A threaded bolt 33 is engaged in aligned transverse holes in the two bars and secured in a threaded portion of one of the holes, the head of the bolt 33 being countersunk so as to lie flush with the surface of the Kelly bar. The bottom end part 36 of the leading Kelly bar 35 is conical and is formed with a coarse driving thread.

Figure 3:
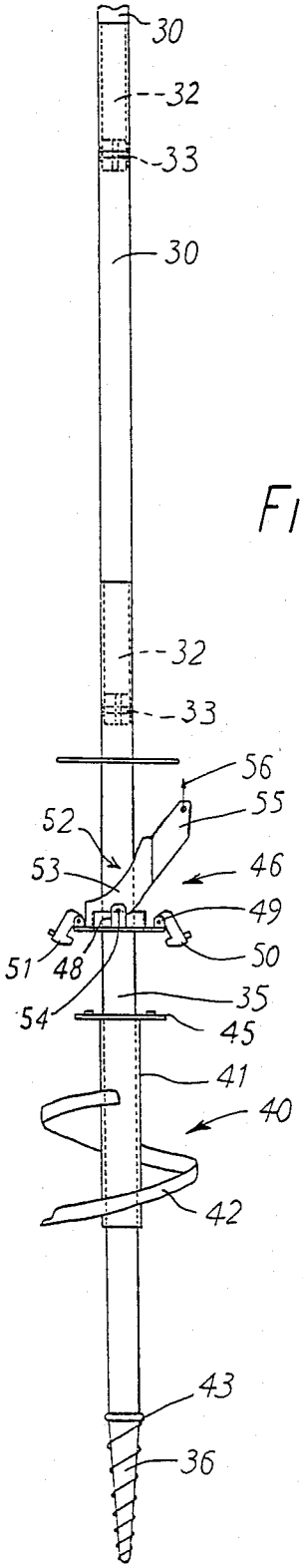
FIG. 3 is a view on an enlarged scale of part of the apparatus of FIGS. 1 and 2, FIGS. 4A and 4B show respectively a plan and front elevation of a frame component of the apparatus, and FIGS. 5 and 6 respectively front and side elevations of a further apparatus according to the invention.
Figure 4A:
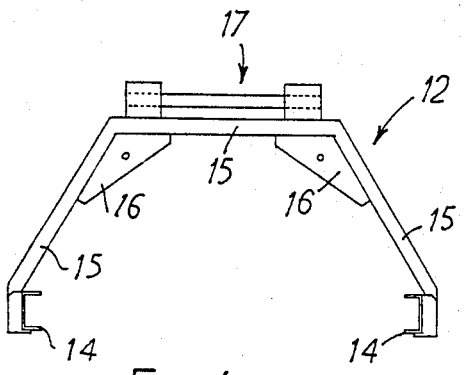
Figure 4B:
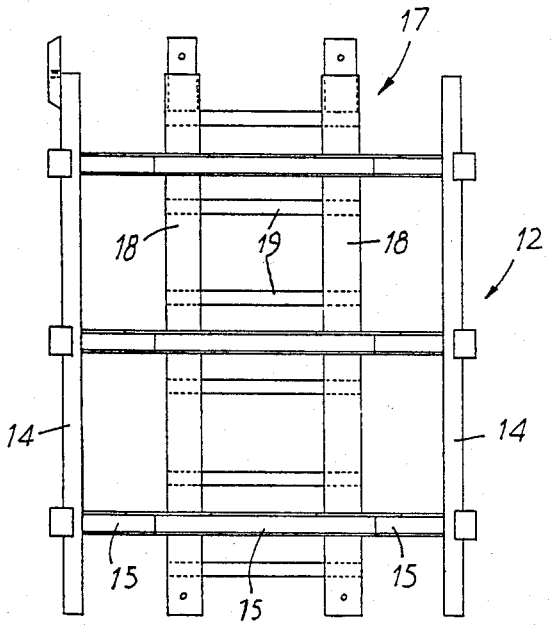

Referring now to FIG. 3 an auger 40 is engaged on the Kelly bars 30 and comprises a square-section sleeve 41 which is slidingly engaged on the Kelly bars but which is driven in rotation by the bars, and an auger blade 42 mounted on and extending about the sleeve. A collar 43 is secured just above the conical portion 36 of the bottom Kelly bar and prevents the sleeve 41 from dropping off the Kelly bars. An annular disc 45 is secured to the top end of the sleeve.

Figure 2:
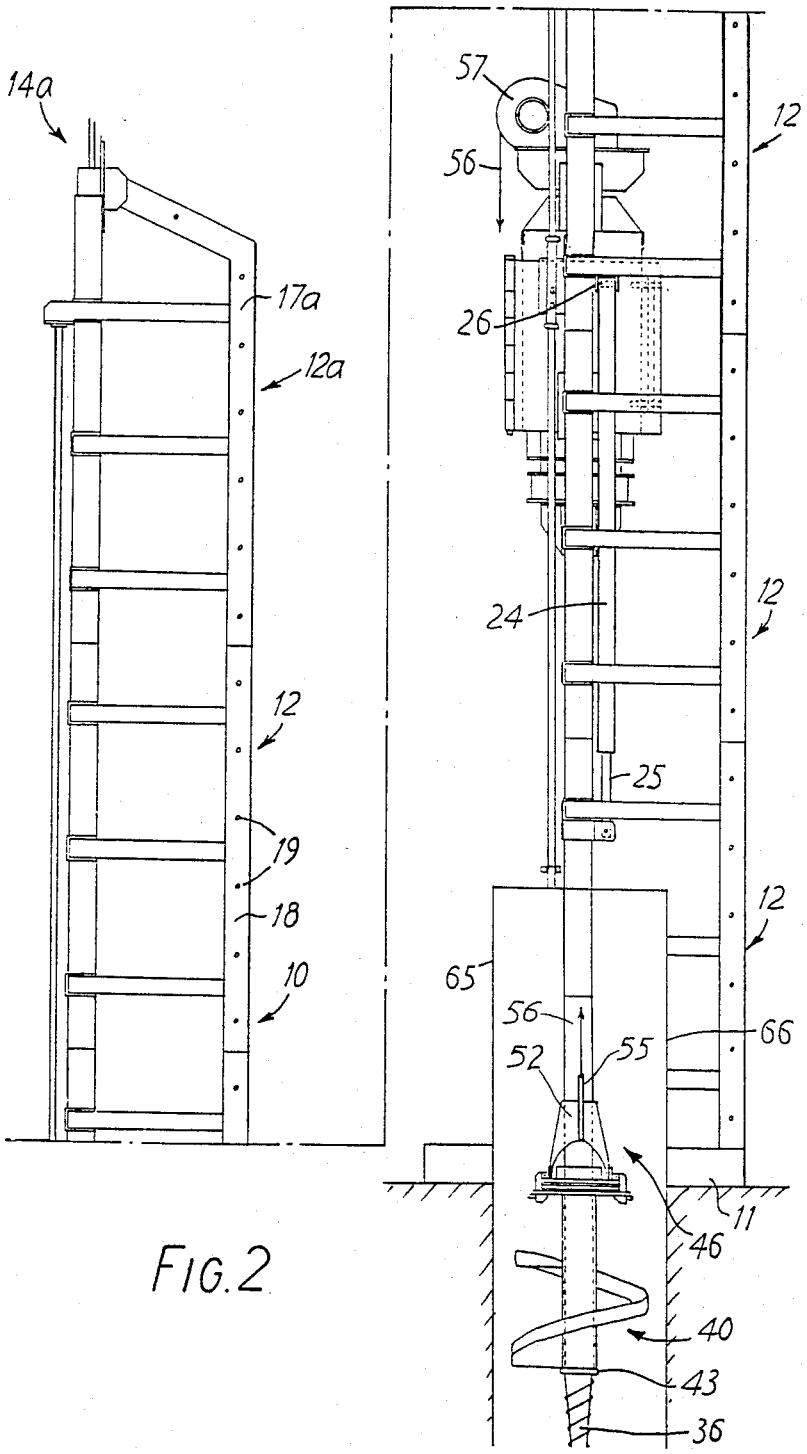
FIG. 2 is a side view of the apparatus of FIG. 1.

The auger 40 is suspended from a carrier 46 which encircles the Kelly bars but which, in operation, is held against rotation with the bars. The carrier comprises an annular base plate 48 on the upper side of which are horizontal pivot mountings 49 for three claws 50 which are angularly spaced by 120° about the axis of the Kelly bars. The claws hang downward and are spring-loaded radially towards the axis of the Kelly bars so as to engage under the edge of the annular disc 45 of the auger. The heads of the claws are chamfered at 51 such that when the carrier and the auger are moved axially towards each other the disc 45 first displaces the claws outward against their spring loading, the claws then snapping in behind the disc so that the auger is supported by the carrier as shown in FIGS. 1 and 2 but can rotate with the Kelly bars. Also mounted on the carrier is a lever 52 the inner end portion 53 of which is tubular and encircles the Kelly bars and is mounted in aligned horizontal pivot mountings 54 on the base plate, the mountings being disposed at diametrically opposite sides of the Kelly bar. The outer end portion 55 of the lever has a hole in it whereby the lower end of a vertically extending cable 56 is attached to the lever. Two stop surfaces on the lever respectively come into abutment with the base plate to prevent the lever from swivelling upward and downward sufficiently far for the tubular portion 53 of the lever to hit the Kelly bars. When the outer end 55 of the lever is in its lowermost position (shown in broken lines in FIG. 1), it projects radially beyond the auger 40, but in its uppermost position (shown in solid lines.) is within the radial compass of the auger. The upper end of the cable 56 attached to the lever is engaged on a winch drum 57 mounted on the carriage 20 and driven by a second rotary hydraulic motor also mounted on the carriage.

A hydraulic valve assembly 58 is mounted on the carriage and enables the supplies of hydraulic fluid to the two hydraulic motors to be adjusted independently of each other. For this purpose two square section vertical rods 59, 60 are rotatably mounted on one channel-section side member 14 of the frame and extend along the full length of the frame. The rods extend slidingly through respective control members 61, 62 for the valves and have respective handles 63, 64 connected to them at their lower ends so that rotation of the rods by means of the handles rotates the control members of the valves to control the motors whatever the position of the carriage along the height of the frame.

In operation of the apparatus, assuming that the hole to be bored is to have a steel liner along its length, a leading section 65 of steel liner having a sharpened bottom edge and a steel rib 66 welded to its internal surface so as to extend axially of the liner is disposed at the location of the hole. The carriage 20 is haulded upward in the frame by means of a block and tackle (not shown) connected to the assembly 14*a* or by any other convenient means, and the leading section 35 of Kelly bar and a first extension piece 30 are connected to the drive socket 29 of the universal coupling member 28 as described above, the carrier 46 and auger 40 having first been engaged on the Kelly bars as shown in FIGS. 1 and 2 of the drawings. The two hydraulic jacks 24 are moved into their fully extended condition, and the carriage 20 is lowered until the weight of the carriage rests via the two upright members 23 on the upper edge of the leading liner section 65, the lower ends of the members 23 being bifurcated to locate them securely on the liner. The auger 40 is attached to the carrier 46 by means of the claws and the carrier and auger are lowered by operating the winch 57 until the auger rests against the collar 43 on the leading section 35 of Kelly bar. The cable 56 is then slackened so that the end 55 of the lever falls downward and radially outward against the side of the liner as shown in chain lines in FIG. 1. By operating the hydraulic jacks 24 the carriage, and the Kelly bars and the auger and carrier assembly are lowered and the hydraulic motor 27 is started to cause the leading section of Kelly bar to rotate and spiral into the ground. As rotation of the Kelly bar commences the outer ends 55 of the lever strikes the rib 66 in the liner, which then prevents the carrier from rotating with the auger and thus ensures that the cable 56 does not become twisted round the Kelly bars. The rib 66 is of insufficient radial height to interfere with the rotation of the auger. As the auger bites into the ground under its own weight and that of the carrier, the cable 56 is maintained slack by the operator. When sufficient spoil has accumulated above the auger, the motor 27 is stopped to stop rotation of the Kelly bars and the winch 57 is operated to haul the carrier 46, the auger 40 and the spoil above the top of the liner section 65. As the cable 56 tightens, the end 55 of the lever is automatically lifted out of engagement with the rib 66 within the liner. Under the combined weight of the carriage and the components mounted on it, the carrier, the auger and the spoil, the liner 65 is forced downward, but additional hydraulic jacks may be disposed vertically between the frame and the top of the liner if necessary during later stages of drilling.

When the spoil has been removed the winch 57 is operated to lower the carriage and auger along the Kelly bars until the cable becomes just slack, the rotation of the Kelly bars is resumed to re-start the boring.

The downward speed of the Kelly bars is governed by the operation of the jacks 24 lowering the weight of the carrier and the equipment mounted thereon on to the Kelly bars, but the jacks are controlled in conjunction with the winch 57 so as to maintain the cable 56 just slack.

When the hydraulic jacks 24 reach a fully contracted condition, drilling is stopped and the top Kelly bar is disconnected from the socket 29 and the carriage is raised by extending the jacks 24 to allow another length of Kelly bar to be connected to the top end of the lengths already in use, the jacks having a working stroke which is substantially longer than the length of Kelly bar. The carriage is then lowered to allow the added length to be engaged and secured in the socket 29. When it becomes necessary to weld a further length of liner 65 to the upper end of the top length of liner, the top Kelly bar is disconnected from the socket 29, and the carrier and jacks 24 are lifted away from the liner by means of the block and tackle to allow this work to be carried out. It will be understood that only the leading liner section 65 has an internal rib 66.

In firm ground where it is unnecessary to drive a steel liner into the hole as it is bored, the lower ends of the uprights 23 are braced against suitable supports on the base member 11. Also in this case the end 55 of the lever performs its function of stopping rotation of the carrier by becoming lodged in the side of the hole since the forces tending to rotate the carrier with the auger are not great. The lever can be readily dislodged by operation of the winch when it is required to hoist the carrier and auger.

Figure 5:
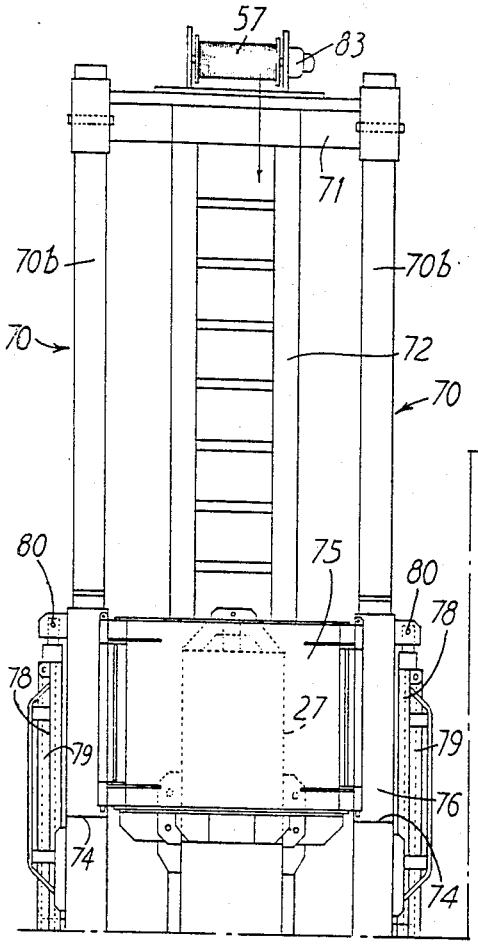
Figure 5:
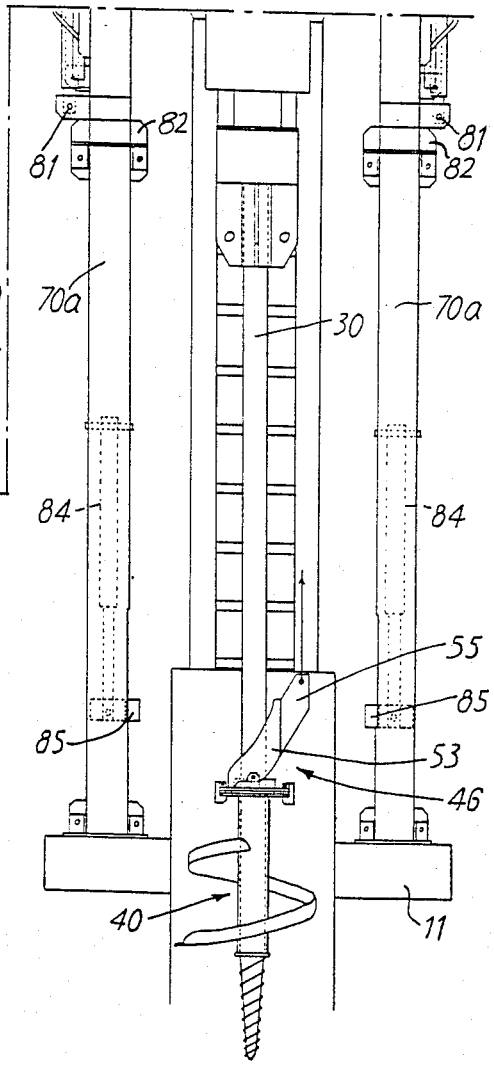
Figure 6:
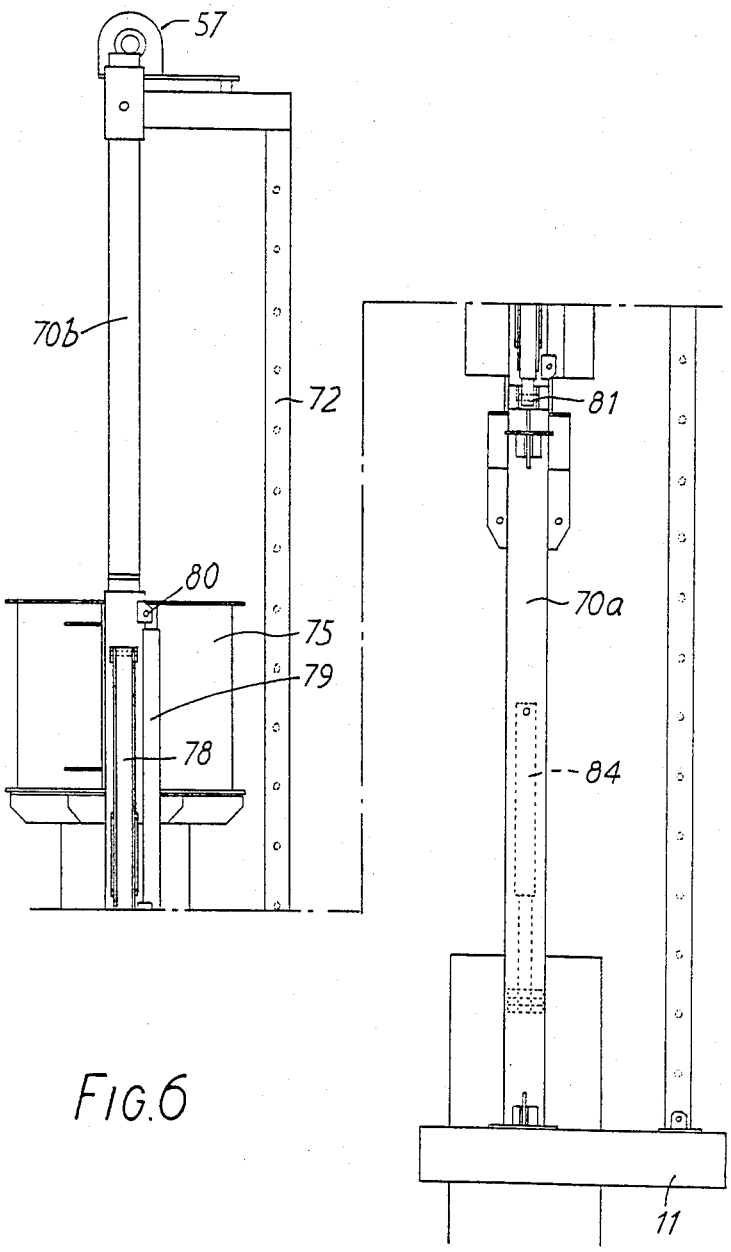

FIGS. 5 and 6 show the main constructional features of an alternative form of the apparatus in which however the construction of the carrier and the auger is similar to that in FIGS. 1 to 3. Components corresponding to those in the construction of FIGS. 1 to 4 are indicated by the same reference numerals. In this alternative form the frame comprises a pair of tubular uprights 70 mounted on a rigid base plate 11 and interconnected at their upper ends by a substantially triangular beam structure 71. An upright bracing member 72 of ladder-like construction is connected between the base plate 11 and the beam structure. The lower portions 70*a* of the tubular uprights have a larger diameter than the upper portions 70*b* and a shoulder 74 is formed at the change of diameter. The carriage 75 is secured to two sleeves 76 respectively slidably engaged on the upper portions 70*b* of the uprights. Sliding movement of the carriage between the lowermost position, shown in the drawings, in which the sleeves 76 abut the shoulder 74 and an uppermost position in which the sleeves are disposed adjacent the beam structure 71 is actuated by two pairs of double-acting hydraulic jacks. The hydraulic jacks 78, 79 of each pair operate in series to give a total movement equal substantially to twice the stroke of the individual jacks. For this purpose the cylinders of the jacks are secured together side by side with their piston rods projecting away from each other, the free ends 80, 81 of the two piston rods being respectively connected to the adjacent sleeve 76 and a bracket 82 on the lower portion of the adjacent upright.

The winch 57 and its hydraulic driving motor 83 are in this construction mounted on the triangular beam structure 71.

Two double-acting hydraulic jacks 84 are respectively disposed internally of the lower portion 70*a* of the uprights and have their cylinders connected to the uprights, and the free ends of their piston rods have connected to them respective brackets 85 which project from the interior of the uprights through lengthwise extending slots in the uprights. The brackets 85 either engage the lip of the liner as in the previously described construction or, if the diameter of the liner does not permit this, press down on opposite ends of a beam resting diametrically across the top edge of the liner when the liner is to be pressed down. With this construction, the base plate 11 will usually be firmly bolted down to a concrete bedding of substantial construction extending about the top of the hole, since otherwise the maximum downward force which can be exerted on the liner is equal to the weight of the boring apparatus. The construction of FIGS. 5 and 6 operate in the same way as that of FIGS. 1 to 4, the carriage being raised and lowered by operation of the two-stage jack arrangement 78, 79, the two jacks of each pair being allowed to contract in succession, by the controlled expulsion of fluid from the cylinder under the weight of the carriage, to lower the Kelly bars. This arrangement gives a relatively small contracted height to the carriage assembly whilst allowing a substantial range of vertical movement thereof.

It is found to be advantageous for there to be a certain amount of play in the connections between the lengths of Kelly bar and in the connection of the top Kelly bar length to the socket 29. The hole is checked for being straight and plumb at frequent intervals during drilling, and if adjustment is found to be needed it is then relatively simple to withdraw the bottom end portion of the leading length of Kelly bar, move it laterally to the new position and to drive it in again there, where it gives required guidance to the auger. The play facilitates the adjustment and has no adverse effects in drilling, since no downward pressure is exerted on the auger through the Kelly bars, and the universal coupling on the output side of the hydraulic motor 27 ensures that any resulting lateral forces on the Kelly bars are not transmitted to the bearings of the motor. If necessary the whole frame of the machine may rock about its anchorage to the ground to accommodate lateral forces.

A useful advantage of each of the two constructions described above is that the apparatus is easily convertible to use as a conventional borlng ring if the auger strikes rock or other solid material through which it is unable to cut. In the construction of FIGS. 1 to 4, this is achieved by removing the auger and carrier, replacing the leading Kelly bar by a rock boring bit, and leading the cable from the winch 57 over a pulley (.not shown.) at the top of the frame and back down to an anchorage on the carriage. The jacks 24 are rendered inoperative, and the winch 57 is used to lower the carriage and string of Kelly bars to bore through the rock. In the construction of FIGS. 5 and 6, the auger and carrier are similarly removed and replaced by a rock boring bit and the lower end of the cable from winch 57 is connected to the carrier 75, jacks 78, 79 being rendered inoperative.

I claim:

1. Apparatus for boring a hole comprising an elongate bar, means for rotating the bar about its lengthwise axis, an auger surrounding the bar which auger is slidable lengthwise of the bar but is not rotatable relative to the bar, a carrier which is slidable along the bar and which is free for rotation relative to the bar, a connection connecting the carrier to the auger, permitting rotation of the auger relative to the carrier, means, disposed on the carrier and selectively movable outward relative to said axis, for engaging the wall of the hole or a liner of the hole to limit the extent of rotation of the carrier about said axis and back from engagement with the wall towards said axis, and means for raising and lowering the carrier along the bar.

2. Apparatus as claimed in claim 1, wherein said means for raising and lowering the carrier along the bar comprises a lifting cable extending along the bar and having its lower end connected to said limiting means such that a lifting movement of the cable automatically renders said limiting means inoperative to limit the extent of rotation of the carrier about said axis.

3. Apparatus as claimed in claim 1, wherein limiting means comprises an element which is selectively movable between a position in which a part of the element projects radially for engagement with the side of the hole or a liner for the hole.

4. Apparatus as claimed in claim 3, wherein the said element is a lever mounted on the carrier for rocking movement about a horizontal pivot axis downward and upward into positions in which the lever projects radially to a greater and lesser extent relative to said lengthwise axis of the bar.

5. Apparatus as claimed in claim 1 further comprising an upright frame for resting on the ground at the site of a hole to be bored, said frame providing vertical guides for disposition at diametrically opposite sides of the top of the hole, a carriage mounted for movement along said guides, a motor mounted on said carriage which motor constitutes said means for rotating the bar, and means connected between the frame and the carriage for raising and lowering the carriage along the guides.

6. Apparatus as claimed in claim 5, wherein said means connected between the frame and the carriage comprises two pairs of hydraulic jacks, the hydraulic jacks of each pair being connected mechanically in series between the frame and the carriage.

7. Apparatus as claimed in claim 5, further comprising a pair of hydraulic jacks respectively extending adjacent and parallel to said vertical guides, said jacks being connected at their upper ends to said carriage and having their lower ends disposed for engaging the top of a tubular liner for a hole to be bored.

8. Apparatus as claimed in claim 5, further comprising a pair of hydraulic jacks for disposition at diametrically opposite sides of a hole to be bored, said jacks being arranged vertically and having their upper ends connected to the frame and their lower ends disposed for engaging the top of a tubular liner for the hole.

9. Apparatus as claimed in claim 5, wherein said means for raising and lowering the carrier comprises a cable drum and a drive motor therefor mounted on the carriage, and a cable extending from the drum to said carrier.

10. Apparatus as claimed in claim 1, wherein the leading end of the bar is substantially pointed.

11. Apparatus as claimed in claim 1, wherein the leading end of the bar is substantially conical and is screw-threaded.

12. Apparatus as claimed in claim 1, wherein the auger extends in substantially a single turn about its axis.

13. Apparatus as claimed in claim 1, wherein said connection is spaced from said limiting means.

14. Apparatus as claimed in claim 1, wherein said connection between the carrier and the auger is a disconnectible connection.

15. Apparatus as claimed in claim 14, wherein the auger comprises an auger blade centred on and secured to a sleeve slidably mounted on, but non-rotatable relative to the bar and wherein the sleeve and the coarier are provided one with a disc secured thereto coaxially with the bar, and the other with a plurality of radially-inwardly spring-loaded claws spaced about said axis and adapted to snap over the edge of the disc, thereby to constitute said disconnectible connection.

16. A method of boring a hole in a ground comprising the steps of: lowering along a vertical bar which is capable of boring into the ground, an assembly comprising an auger and a carrier therefor until the auger reaches the ground, the carrier and the auger being mounted on and concentrically with the bar, the carrier being free for rotation relative to the bar and the auger, and the auger being suspended from the carrier and in driven engagement with the bar; moving a device on the carrier radially outward into engagement with the wall of the hole or a liner of the hole to prevent the carrier from rotating in the hole; causing the bar and auger to rotate to collect spoil and, when the auger has collected a quantity of spoil, moving the device back inward out of engagement with the wall or liner; and causing the carrier, with the auger suspended therefrom, to be hoisted along the bar.

17. A method as claimed in claim 16, wherein motor means for driving the bar in rotationm, a second motor means, and a winch which operates to hoist and lower the auger and carrier assembly and which is driven by the second motor means are all mounted on a carriage which is guided for vertical movement, further comprising the step of placing a cylindrical liner for the hole about the bar which liner has a diameter greater than the cutting diameter of the auger, and supporting the weight of the carriage on the top edge of the liner, whereby the weight of the carriage, the first and second motor means and, the winch, and during hoisting of the said assembly, weight of the auger and carrier, operate to force the liner down into the hole.

* * * * *